United States Patent [19]

Rouanes

[11] Patent Number: 4,567,874

[45] Date of Patent: Feb. 4, 1986

[54] IGNITION SYSTEM FOR INTERNAL COMBUSTION ENGINES

[75] Inventor: Philippe Rouanes, Blanquefort, France

[73] Assignee: Siemens Aktiengesellschaft, Berlin and Munich, Fed. Rep. of Germany

[21] Appl. No.: 565,519

[22] Filed: Dec. 27, 1983

Related U.S. Application Data

[63] Continuation of Ser. No. 236,522, Feb. 20, 1981, abandoned.

[30] Foreign Application Priority Data

| | | | |
|---|---|---|---|
| Feb. 21, 1980 | [FR] | France | 80 03831 |
| Feb. 29, 1980 | [FR] | France | 80 04557 |
| Jul. 15, 1980 | [FR] | France | 80 15617 |
| Sep. 12, 1980 | [FR] | France | 80 19737 |

[51] Int. Cl.[4] ..... F02P 7/06

[52] U.S. Cl. ..... 123/606; 123/634

[58] Field of Search ..... 123/606, 607, 621, 637, 123/146.5 A, 640, 650, 634; 315/209 M

[56] References Cited

U.S. PATENT DOCUMENTS

| | | | |
|---|---|---|---|
| 1,995,917 | 3/1935 | Davis, Jr. | 123/640 |
| 2,781,412 | 2/1957 | Mike | 123/650 |
| 2,940,013 | 6/1960 | Cook | 123/606 |
| 2,976,461 | 3/1961 | Dilger et al. | 123/607 |
| 3,749,973 | 7/1973 | Canup | 123/606 |
| 3,888,221 | 6/1975 | Stacey, Jr. | 123/146.5 A |
| 4,015,576 | 4/1977 | Junak | 123/606 |
| 4,194,480 | 3/1980 | Rado | 123/146.5 A |
| 4,217,872 | 8/1980 | Rabus et al. | 123/637 |
| 4,245,594 | 1/1981 | Morino et al. | 123/606 |

FOREIGN PATENT DOCUMENTS

| | | | |
|---|---|---|---|
| 2407362 | 10/1977 | France . | |
| 1438448 | 6/1976 | United Kingdom | 123/606 |

*Primary Examiner*—Andrew M. Dolinar

*Attorney, Agent, or Firm*—Herbert L. Lerner; Laurence A. Greenberg

[57] ABSTRACT

Ignition system for an internal combustion engine in a motor vehicle having at least one transformer for generating ignition voltage, the transformer having a primary side with a primary winding and a secondary side with a secondary winding, and a spark plug connected to the secondary winding including an electronic circuit connected to the primary winding, chopper means fed by a d-c or rectified a-c source for activating the transformer, and switch means disposed on the second side of the transformer.

7 Claims, 17 Drawing Figures

IGNITION SYSTEM FOR INTERNAL COMBUSTION ENGINES

This application is a continuation of application Ser. No. 236,522, filed Feb. 20, 1981, now abandoned.

The invention relates to an ignition system for internal combustion engines, in particular Otto engines in motor vehicles, wherein one or more transformers are provided for generating an ignition voltage, the transformer having a secondary winding to which spark plugs are connected.

In constructing ignition systems for internal combustion engines, it is increasingly necessary to provide for good combustion of the fuel mixture, especially in the low engine-speed range and the range of lean fuel-mix compositions in order to obtain good energy utilization, on the one hand, and the least possible air pollution, on the other hand.

These requirements are not adequately met by conventional ignition systems wherein the high voltage is generated by ignition coils and/or by capacitive devices, and wherein an exponentially decreasing ignition spark is produced at the spark plugs.

Heretofore known from German Published Prosecuted Application (DE-AS) No. 28 46 425, is an ignition system wherein the circuit between the primary and secondary coils is realized by a single magnetic circuit. Therein, one primary coil, and in another embodiment, two primary coils, supplied with a dc voltage, are provided.

The high voltage required for the ignition is generated by interrupting the current flow in the primary coil or coils. This process is independent of the engine speed.

It is an object of the invention to provide an ignition system for internal combustion engines, especially Otto engines in motor vehicles, through which a high voltage is generated at the spark plugs, and in which the duration of the ignition spark can be set or adjusted sufficiently long, especially in the low engine speed range.

In accordance with another feature of the invention there is provided an ignition system for an internal combustion engine in a motor vehicle having at least one transformer for generating ignition voltage, the transformer having a primary side with a primary winding and a secondary side with a secondary winding, and a spark plug connected to the secondary winding including an electronic circuit connected to the primary winding, chopper means fed by a d-c or rectified a-c source for activating the transformer, and switch means disposed on the second side of the transformer.

In accordance with an additional feature of the invention, the primary winding of the transformer is disposed in an LC oscillator circuit.

In accordance with an added feature of the invention there is provided a plurality of the transformers, the primary windings thereof being connected in parallel.

In accordance with yet another feature of the invention there is provided an auxiliary winding disposed on the secondary side of the at least one transformer, a control circuit connected to the auxiliary winding and inductively coupled to the chopper means.

In accordance with yet a further feature of the invention, the chopper means include a transistor having an emitter-collector path connected in series with the primary winding of the at least one transformer, the voltage source being connected to the series connection, the transistor having a base connecting to the control circuit.

In accordance with yet an additional feature of the invention, the base of the transistor is additionally connected to another control circuit having an RC series connection connected to the voltage source and a diac disposed between the RC series connection and the base of the transistor.

In accordance with yet an added feature of the invention, the control circuit includes a transformer-fed voltage limiter or integrator for generating a square-wave voltage, and means for varying pulse delay and/or pulse length being supplied by the square-wave voltage.

In accordance with an alternate feature of the invention there is provided a transistor stage and a transformer with an overvoltage protection circuit connected in parallel with the primary winding are disposed between an output of the pulse delay and/or pulse length varying means and the base of the transistor.

In accordance with a still further feature of the invention, the one transformer having the auxiliary winding is connected in a tank circuit, the tank circuit together with the control circuit and the chopper means being accommodated in a single integral unit, and including additional transformers with respective tank circuits constructed as additional integral units.

In accordance with another feature of the invention there are provided respective supplementary windings for a plurality of the transformers disposed at the secondary windings of the respective transformers and having circuits provided with switch means for opening and short-circuiting the circuits.

In accordance with a further feature of the invention, the at least one transformer comprises a magnetic core and a primary and a secondary coil disposed thereon, the core being of a construction so that a primary coil and a plurality of secondary coils are disposable thereon.

In accordance with an additional feature of the invention, the magnetic core is formed of ferrite material.

In accordance with an added feature of the invention, the magnetic core is formed of four yokes disposed in mutually cruciform arrangement having at an intersection thereof a bridge whereon the primary coil is disposed, the plurality of secondary coils being disposed, respectively on the yokes.

In accordance with yet a further feature of the invention there are provided respective auxiliary windings disposed on the secondary coils of the at least one transformer, and switch means for short-circuiting and opening the auxiliary windings.

In accordance with still an additional feature of the invention, the at least one transformer has a single secondary winding, and including interrupter means series-connected to each of the spark plugs, the secondary winding being connected via the interrupter means to the spark plugs.

In accordance with still an added feature, the interrupter means comprise reed relays.

In accordance with yet an alternate feature of the invention there are provided sensors operatively associated with the switch means and disposed at suitable locations of the internal combustion engine for controlling the switch means in accordance with conditions sensed thereby.

In accordance with a still further feature of the invention, the switch means are mechanical.

In accordance with another feature of the invention, the switch means are electromechanical.

In accordance with a concomitant feature of the invention, the switch means are electronic.

Other features which are considered as characteristic for the invention are set forth in the appended claims.

Although the invention is illustrated and described herein as embodied in an ignition system for internal combustion engines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 9:
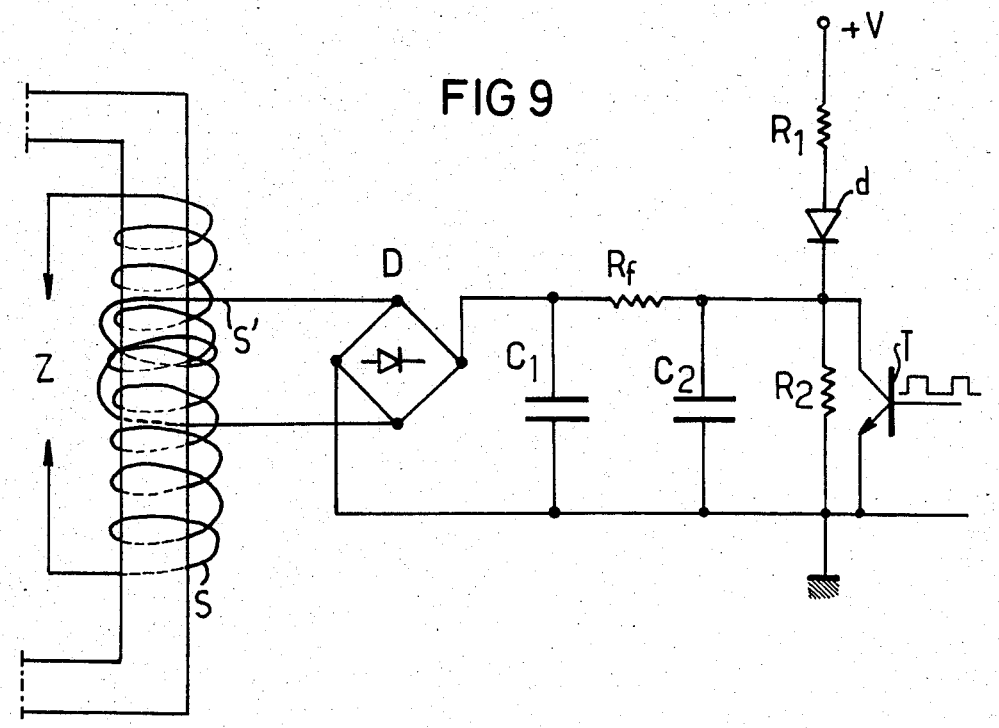
Figure 8:
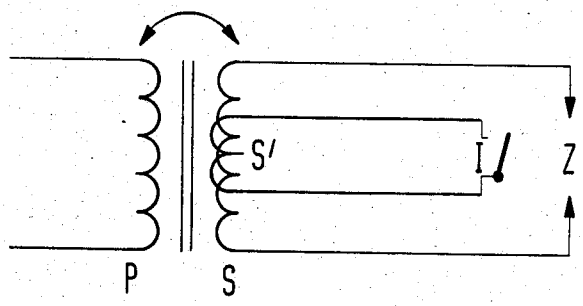
FIG. 8 is a circuit diagram of one embodiment of a secondary control.
Figure 8A:
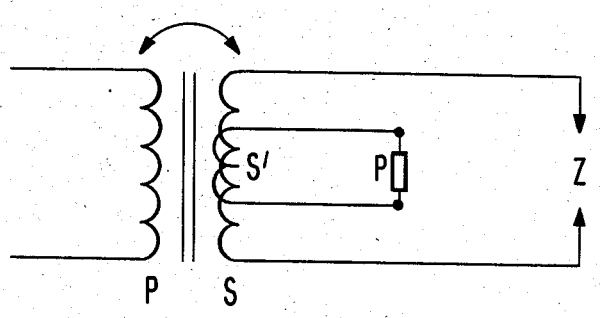
Figure 10:
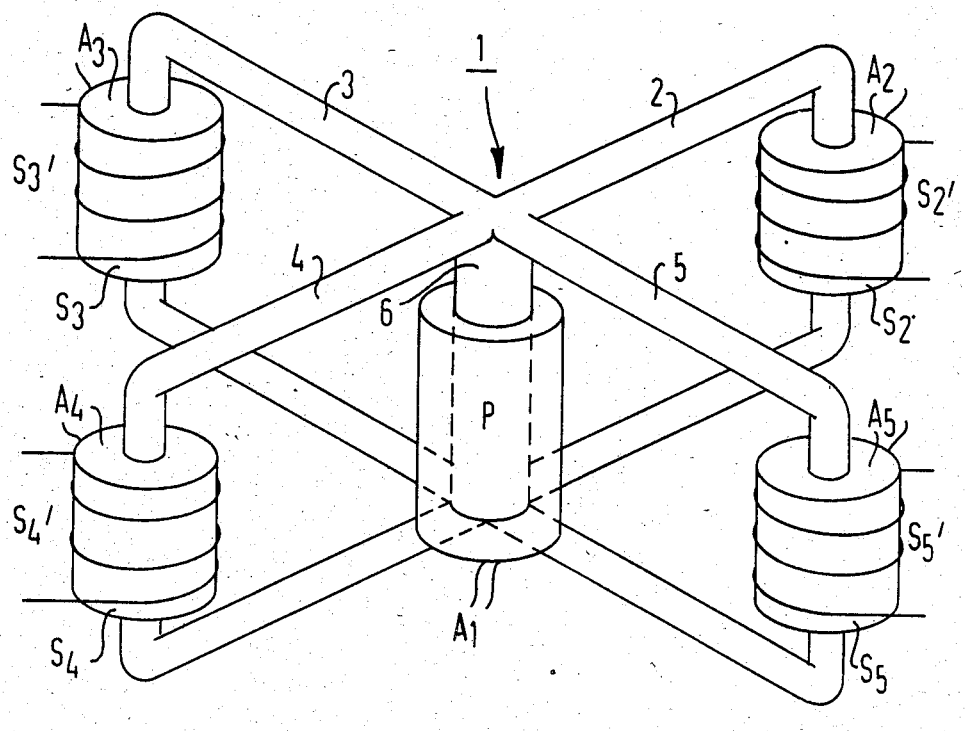
Figure 11:
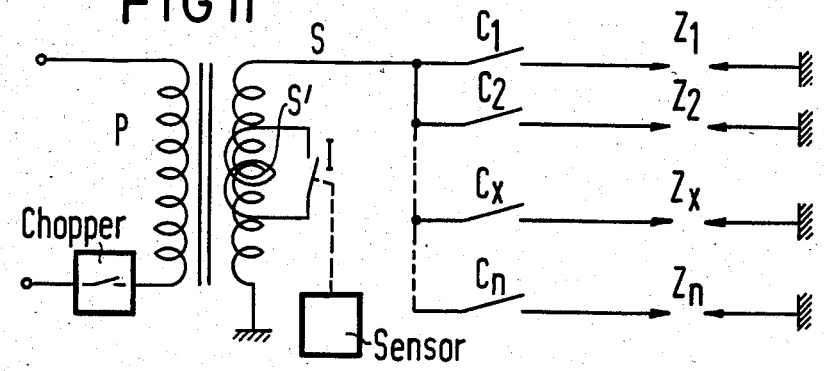
Figure 12:
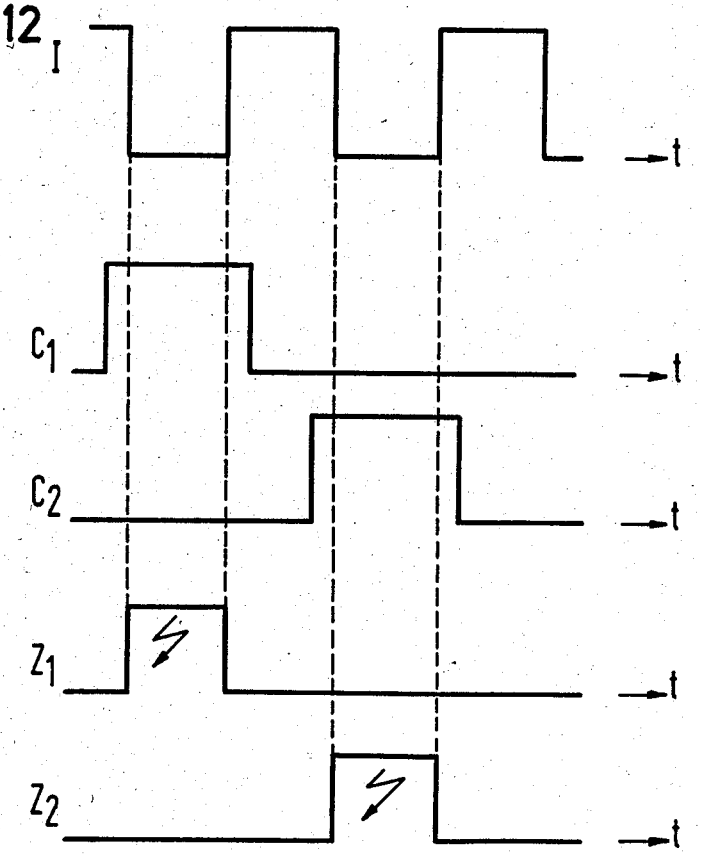
Figure 13:
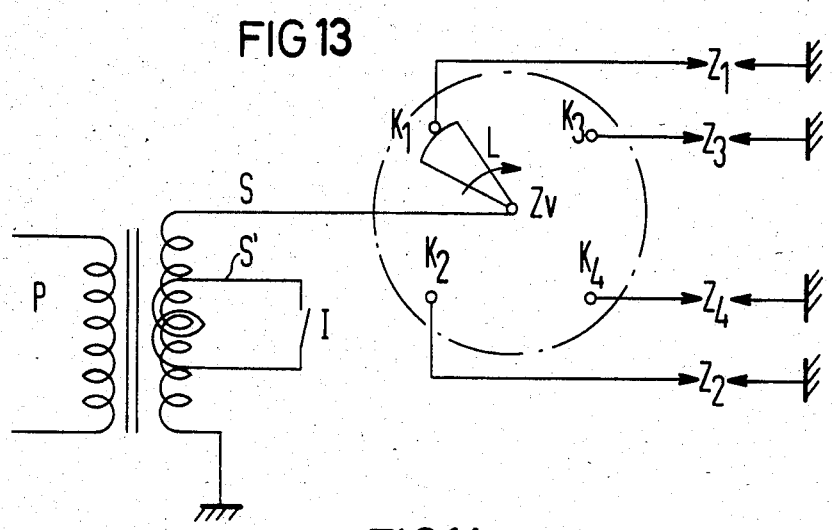
Figure 14:
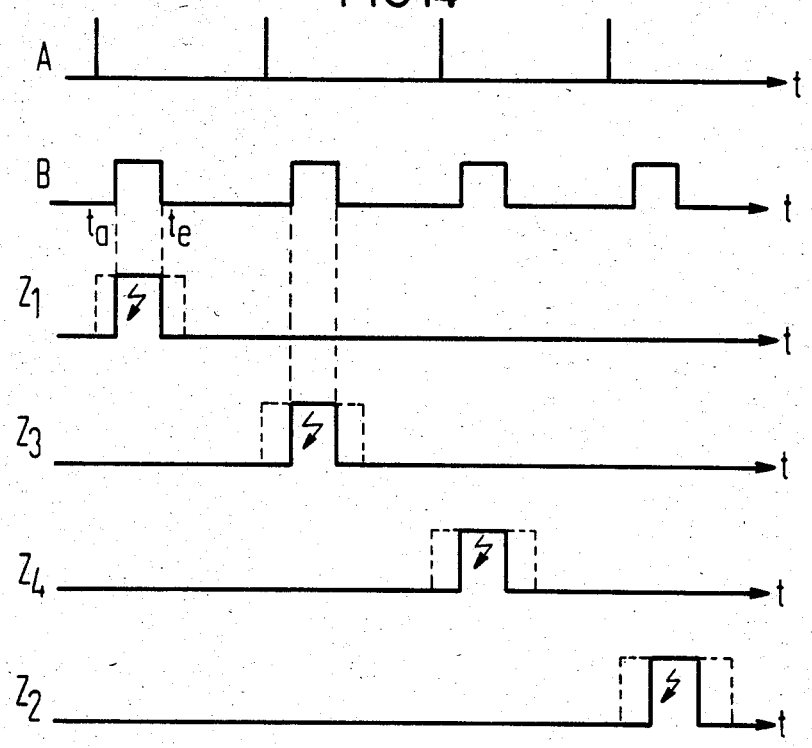
Figure 15:
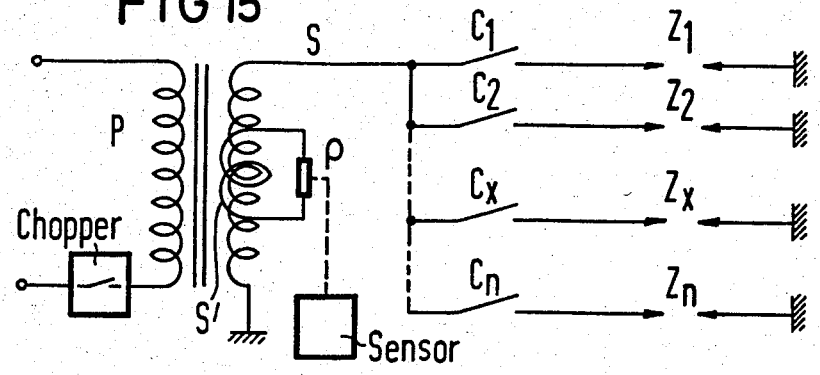
Figure 16:
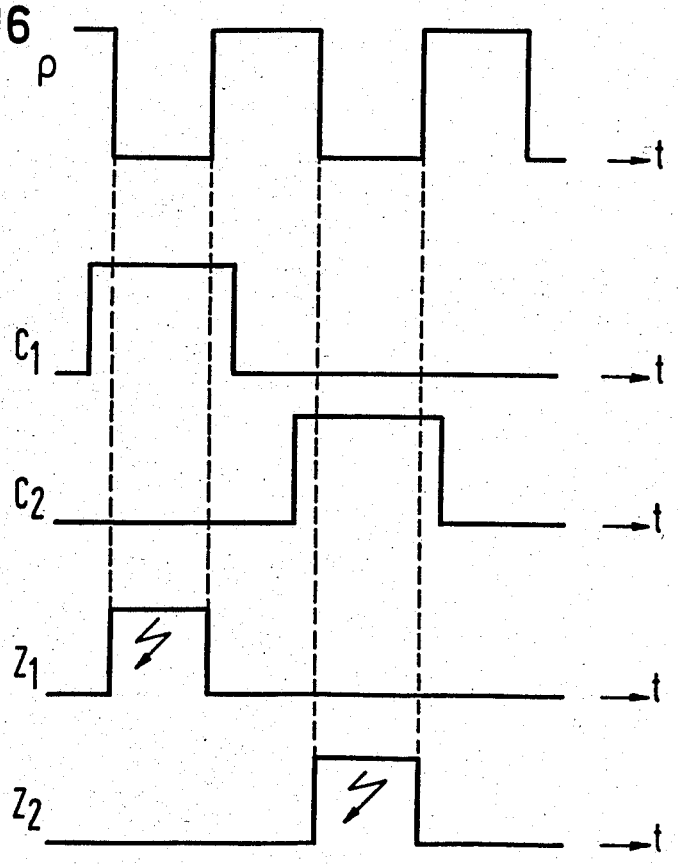

FIG. 8*a* is a circuit diagram of another embodiment of a secondary control;

FIG. 9 is a circuit diagram of another embodiment of the control on the secondary side;

FIG. 10 is a perspective view, partly diagrammatic, of an embodiment of a transformer for the ignition system according to the invention;

FIG. 11 is a circuit diagram of an embodiment of the ignition system of the invention with a single secondary winding;

FIG. 12 is a plot diagram of the mode of operation of the ignition system acording to FIG. 11;

FIG. 13 is a circuit diagram of an embodiment of the ignition system with an ignition distributor;

FIG. 14 is a plot diagram of the mode of operation of the ignition system according to FIG. 13;

FIG. 15 is a circuit diagram of another embodiment of the ignition system with a single secondary winding; and FIG. 16 is a plot diagram of the mode of operation of the ignition system according to FIG. 15.

Figure 1:
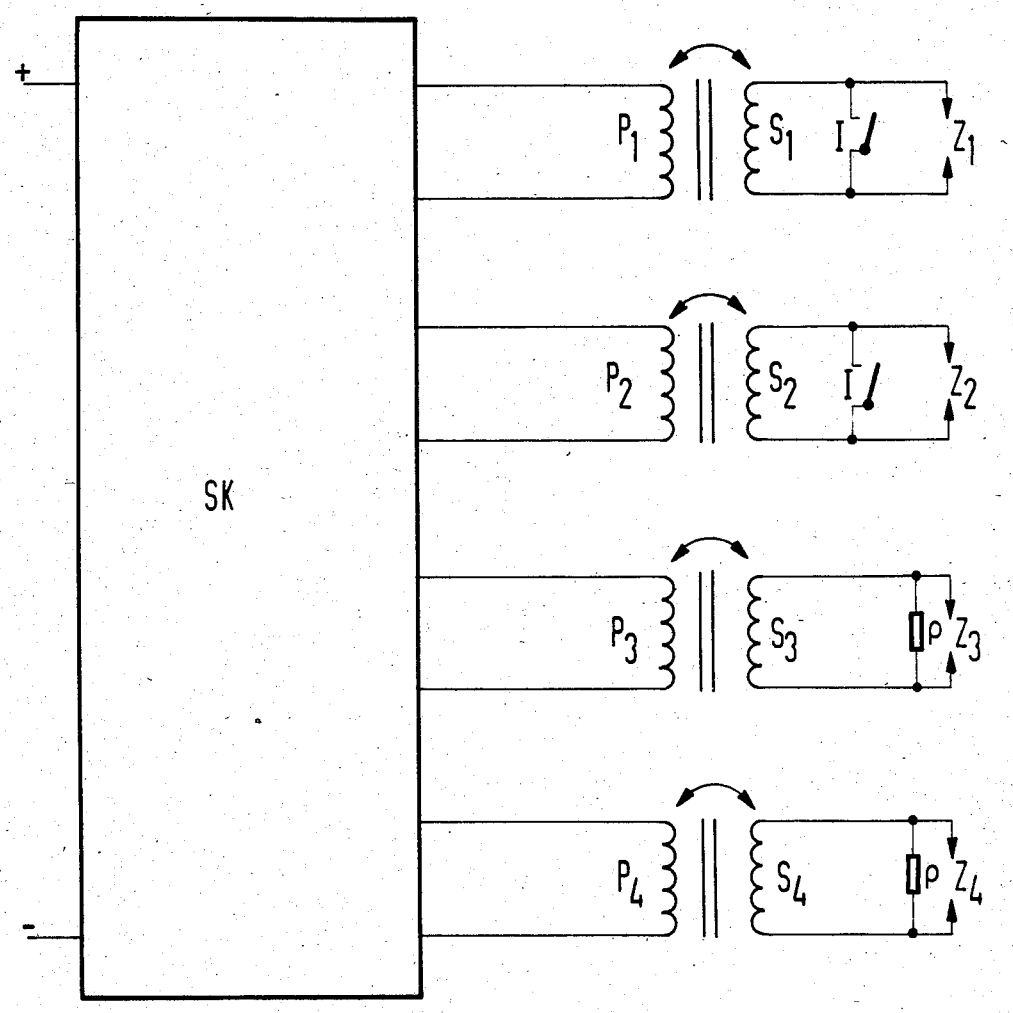
FIG. 1 is a circuit diagram of an ignition system according to the invention.

Referring now to the drawing and first, particularly, to FIG. 1 thereof, there is shown an ignition system for a 4-cylinder engine wherein a transformer, fed by a control circuit SK and having primary windings $P_1$ to $P_4$ and secondary windings $S_1$ to $S_4$, is coordinated with each of four spark plugs $Z_1$ to $Z_4$. The secondary windings $S_1$ to $S_4$ are connected to the electrodes of the spark plugs $Z_1$ to $Z_4$, the secondary windings $S_1$ and $S_2$ being bridged by mechanical switches I, and the secondary windings $S_3$ and $S_4$ by electromechanical or electronic switches $\rho$. These switches are constructed so that only a weak short-circuit current flows in the event of a short-circuit.

Ignition sparks at the electrodes of the spark plugs $Z_1$ to $Z_4$ are produced when the mechanical switches I or the electronic switches $\rho$ are opened. Then, the voltage required to produce the ignition spark at the electrodes of the spark plugs $Z_1$ to $Z_4$ is formed.

The electronic switch $\rho$ may be formed, for example, as an impedance or variable resistor capable of assuming controllable high and low impedance, respectively, and resistance values, respectively, depending upon whether ignition is desired or not. The impedance may be applied to the terminals of the spark plugs and may be a fedback impedance (such as an auxiliary winding directed to the secondary winding $\rho$, for example). $\rho$ should be selected so that only a weak current flows.

Figure 2:
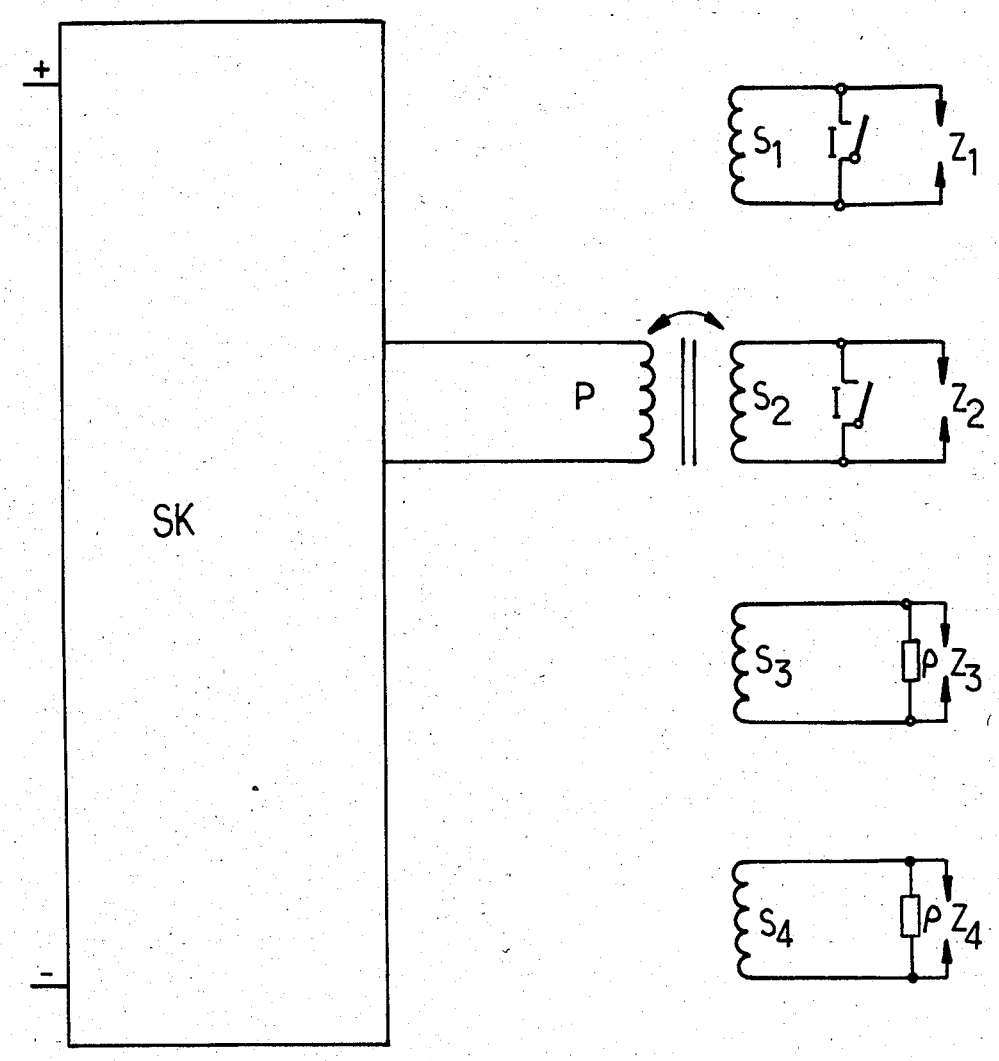
FIG. 2 is a circuit diagram of another embodiment of the ignition system with a transformer having a single primary and several secondary windings.

Depicted in FIG. 2 is an embodiment of the ignition system according to the invention wherein a transformer with a single primary winding P and a respective secondary winding $S_1$ to $S_4$ is used for a motor with four spark plugs $Z_1$ to $Z_4$. This affords a more compact construction of the ignition system, and the energy present in the motor vehicle can also be utilized more economically.

Figure 3:
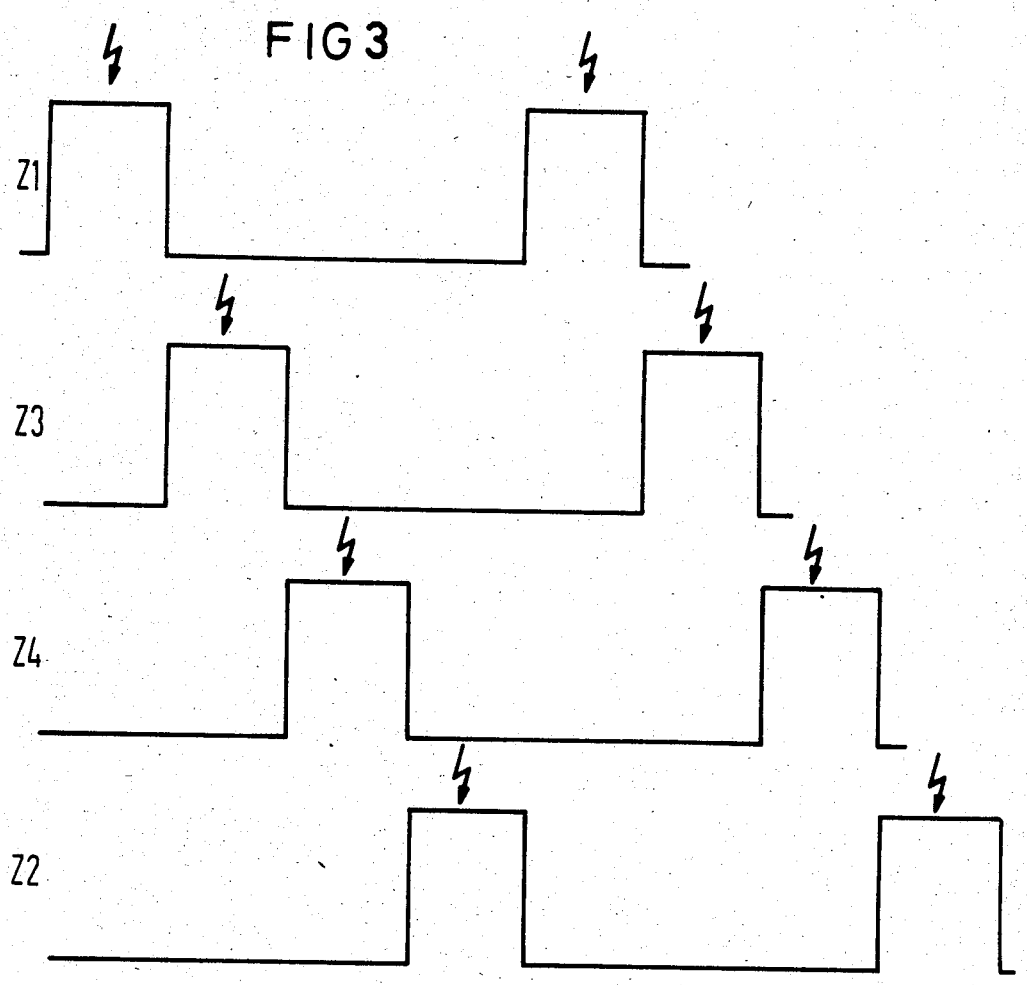
FIG. 3 is a plot diagram of the ignition sequency in a 4-cylinder engine.

The ignition cycle for a 4-cylinder engine is shown in FIG. 3. The ignition point or instant of ignition is determined therein by a mechanical and electronic switch, respectively, disposed on the engine crankshaft, for example. It is also possible to select arbitrarily the duration of the ignition spark through the open time of the mechanical, electromechanical and electronic switch I and $\rho$, respectively. This duration may be determined arbitrarily by mechanical, electromechanical devices coupled to other functions of the motor vehicle.

Figure 4:
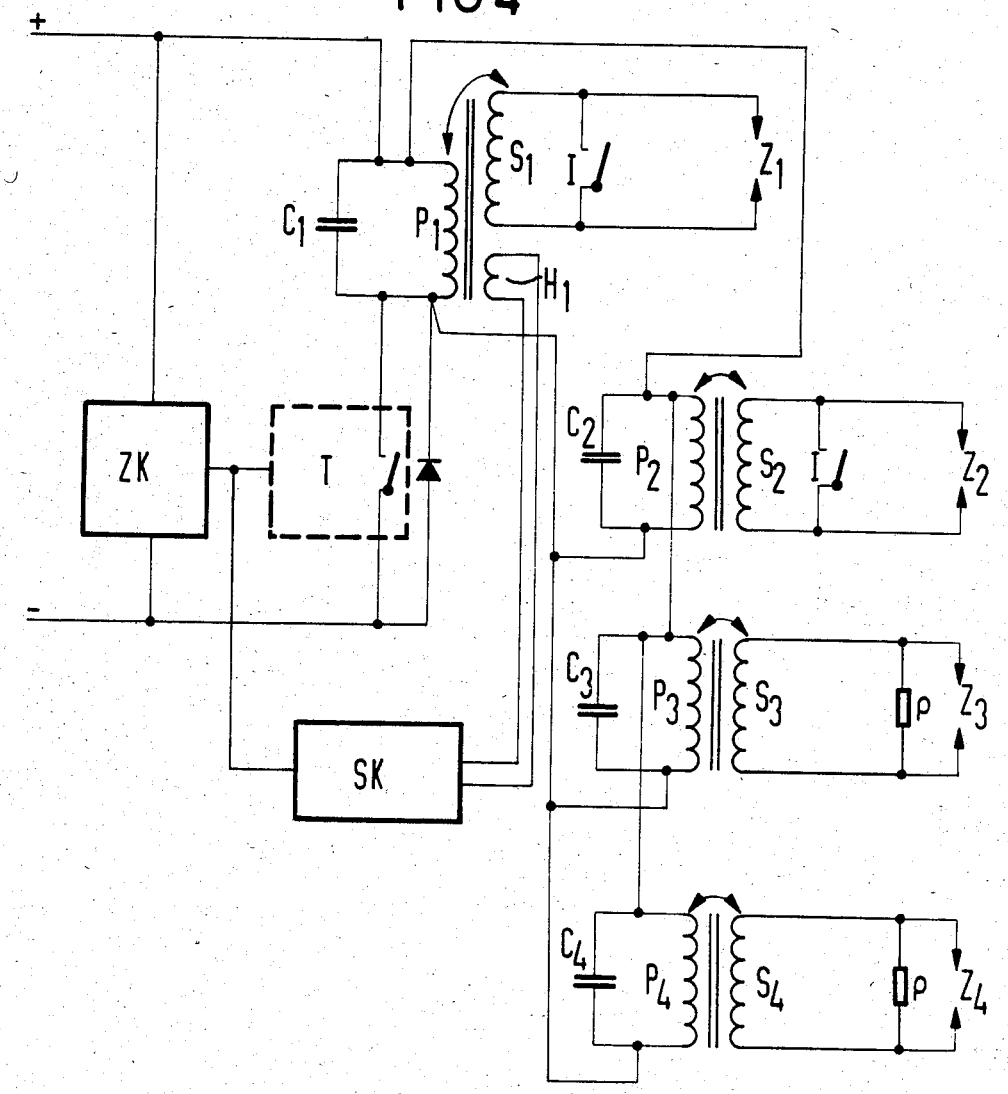
FIG. 4 is a circuit diagram of a third embodiment of the ignition system according to the invention.

Another embodiment of an ignition system according to the invention is shown in FIG. 4. Therein, the primary windings $P_1$ to $P_4$ of the transformers are connected in parallel to each other and disposed in an LC oscillator circuit with capacitors $C_1$ to $C_4$. Provided at one of the transformers is an auxiliary winding $H_1$ which furnishes the information required for the operation of the electronic control circuit SK. Also disposed in the ignition system is an ignition circuit ZK which controls the mechanical, electromechanical and electronic interrupter T, respectively. Through the ignition system according to FIG. 4 an ignition spark of high voltage and a high/low frequency is formed at the spark plugs $Z_1$ to $Z_4$. The magnitude of the voltage is determined by the transformer design and by the frequency chopper driven by a dc or rectified ac voltage source. The intensity of the ignition current is, on the one hand, likewise determined by the transformer design and by, on the other hand, the closed time of the interrupter element T.

Figure 5:
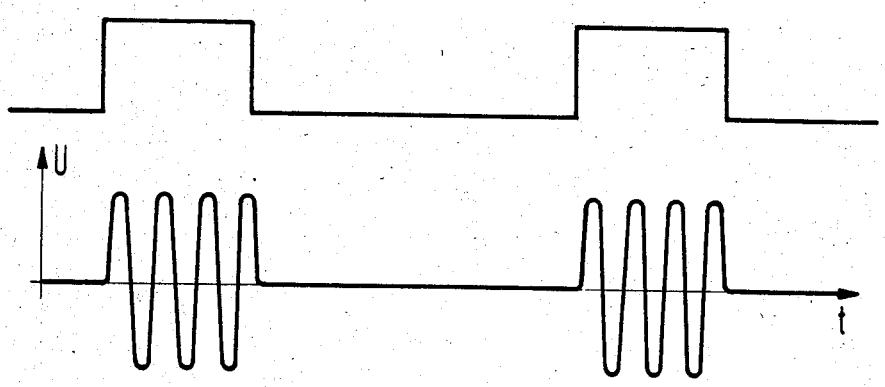
FIG. 5 is a plot diagram of a pulse spectrum of the ignition spark.

FIG. 5 shows which voltage spectrum U is produced at the secondary windings of the transformers, depending upon whether the mechanical, electromechanical and electronic switches I or $\rho$, respectively, are open or closed. If required, the secondary voltage may be rectified and filtered.

Figure 6:
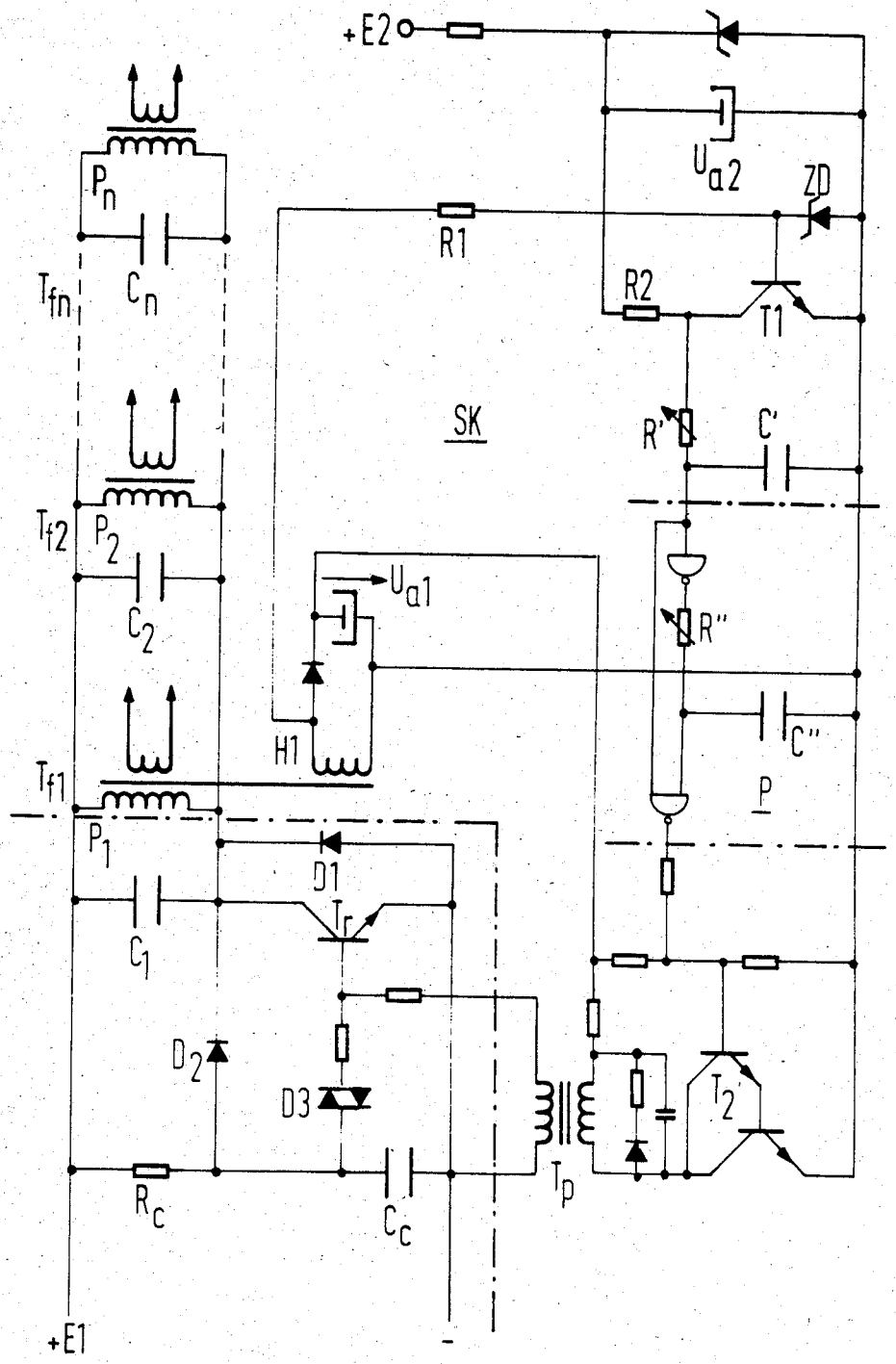
FIG. 6 is a circuit diagram of the electronic control circuit forming part of the ignition system of the invention.

Shown in FIG. 6 is a circuit arrangement of the electronic control circuit SK. A series connection formed of the emitter-collector path of the transistor Tr and the parallel connection of the tank circuits $C_1$–$P_1$, $C_2$–$P_2$, $C_n$–$P_n$ is connected to the dc voltage source +, −. In addition, the RC series connector $R_c$, $C_c$ is connected to the dc voltage source +, −.

When the input voltage is applied, the capacitor $C_c$ charges via the resistor $R_c$. As soon as the voltage thereof reaches the ignition voltage of the diac $D_3$, the latter transmits a pulse which controls the power transistor Tr to be conducting. Therefore, an overvoltage appears on the terminals of the tank circuit $P_1$–$C_1$. A voltage of the same kind as the voltage on the primary winding $P_1$ appears on the auxiliary winding $H_1$.

The diode $D_2$ serves the purpose of discharging the capacitor $C_c$ whenever the transistor Tr is conducting so that the diac is prevented from giving a pulse to the base of the transistor Tr when the latter is blocked.

On the other hand, the arrangement formed of the RC member $R_c C_c$, the diac $D_3$ and the diode $D_2$ may be replaced by another pulse generator which, after switch-on, transmits one pulse only e.g. through a monostable multivibrator or through a very low frequency oscillator which is blocked automatically after transmitting the first pulse.

From this ac voltage, preferably of a frequency of about 20 kHz, a square-wave voltage is obtained by voltage limitation by means of the resistor $R_1$ abd the diode ZD. The base-emitter path of the transistor $T_1$ is connected in parallel with the diode ZD. The collector of this transistor $T_1$ is connected to the auxiliary voltage $E_2$ via the resistor $R_2$. This auxiliary voltage $E_2$ may be derived from the dc voltage $E_1$ or by rectification of the tank circuit voltage applied to a transformer winding such as a primary winding or the winding $H_1$, for example.

Consequently, square-wave pulses produced from the ac voltage applied to the winding $H_1$ by rectification and pulse formation appear at the collector of the transistor $T_1$.

Connected to the collector of the transistor $T_1$ is the RC member formed of the variable resistor R′ and the capacitor C′. Post-connected to the capacitor C′ is a pulse generator P which transmits square-wave pulses as a function of the time curve of the voltage applied to capacitor C′. If the voltage fed to the pulse generator exceeds a specified threshold, the output will transmit a pulse, the length or duration of which is determined by the pulse generator itself.

The pulse generator P is formed of a NAND member having one input directly connected to the capacitor C′, and an RC member R″ is inserted in the transmission path with negation of the input voltage. On the other hand, a transistor circuit or, for example, a Schmitt trigger succeeded by a monoflop may serve as pulse generator.

Following the pulse generator P is a transistor stage containing a transistor arrangement $T_2$ formed as a Darlington circuit. This transistor stage is fed by an auxiliary voltage $U_{a1}$ obtained by rectification of the ac voltage applied to the auxiliary winding $H_1$. Inserted in the collector circuit of the transistor $T_2$ is the primary winding of the transformer $T_p$ which has a secondary winding connected to the base-emitter of the transistor Tr.

The control circuit connected to the auxiliary winding $H_1$ transmits square-wave control pulses to the base of the transistor Tr. These square-wave pulses are furnished by the transistor arrangement $T_2$ and fed to the base of the transistor Tr via the control transformer Tp.

The time during which the transistor $T_2$ is conducting is determined by the length or duration of the pulses generated by the pulse generator P. At the output of the pulse generator P, there appear pulses variable with respect to both the timing and the length or duration thereof. The timing thereof is fixed by means of the variable resistor R′ so that the transistor Tr is conducting when the current $I_{P1}$ goes through zero. The pulse length or duration is determined by means of the resistor R″. The intensity of the ignition spark is variable by varying the pulse length or duration. Therefore, the resistor R″ affords control of the spark intensity.

In a modification of the circuit arrangement shown in FIG. 6, the voltage serving to control the pulse generator may, if applicable, be obtained by integration of the voltage applied to the auxiliary winding $H_1$, in which case the diode ZD must be replaced by an integrating member.

Because of the overvoltage at the tank circuit $C_1$–$P_1$, the voltage reaching the collector-emitter path of transistor Tr can reverse its polarity. To protect against such voltages, a diode so poled as to be stressed by the dc input voltage in blocking direction is disposed in parallel with the collector-emitter path.

Figure 7:
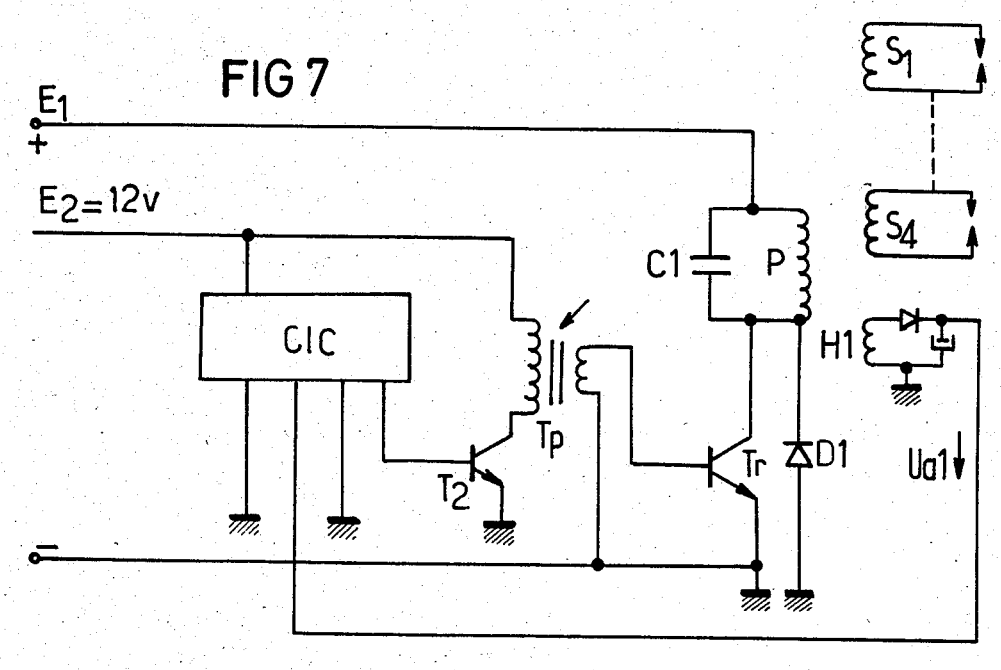
FIG. 7 is a circuit diagram of another embodiment of the electronic control circuit of FIG. 6.

Accordingly, ignition sparks of high voltage and high/low frequency are produced at the spark plugs by the electronic control. In FIG. 7, there is shown another embodiment of the circuit arrangement according to FIG. 6, with which a higher degree of integration is achievable. Corresponding parts have been identified by the same reference characters.

CIC represents an integrated circuit which assumes the control function required for the transistor $T_2$. FIG. 7 depicts an ignition system which uses a transformer with a single primary winding P, with which the appropriate secondary windings $S_1$ to $S_4$ and the auxiliary winding $H_1$ are associated.

In FIGS. 8 and 8*a*, there is shown a particularly advantageous control system according to the invention for firing the spark plugs Z. Applied to the secondary winding S of the transformers is a supplementary winding S′, the circuit of which can be shorted or opened by the mechanical switches I in FIG. 8 or by the electromechanical or electronic switches $\rho$ in FIG. 8*a*. The consequence of short-circuiting the supplementary winding by the switches I or $\rho$ is the disappearance of the secondary voltage of the winding S, or the intensity is reduced to such extent that no ignition spark is formed at the spark plugs Z. In contrast thereto, when the switches I or $\rho$ are open, the required voltage reaches the electrodes of the spark plugs Z so that proper ignition can occur (see also FIG. 5). The advantage of this inventive principle of the generation and destruction, respectively, of the high voltage on the secondary side is that this occurs without having any effect upon or influencing the primary side P of the transformers.

According to the embodiment in FIG. 9, an ac voltage rectified by the rectifier D and filtered by means of the parallel-connected capacitors $C_1$ and $C_2$ is generated in the supplementary winding S′. Moreover, the resistor $R_f$ is inserted in the filter circuit for smoothing. Parallel to the filter circuit is the parallel connection of a resistor $R_2$ to the transistor T, through which the control pulses for the ignition start and finish are generated. Connected to the junction of resistor $R_2$ and the collector of transistor T is a diode d with a current limiting resistor $R_1$, the diode d being also connected through the resistor $R_1$ to the positive pole +V of the motor vehicle voltage source.

If the transistor T is blocked, the voltage generated in the rectifier D disappears completely at the resistor $R_2$; thereby, an increased impedance is formed so that a high voltage is applied to the terminals of the secondary winding S, due to which the ignition sparks in the spark plugs Z are formed.

If, on the other hand, the transistor T is conducting, the voltage between collector and emitter (and hence the voltage drop at the resistor $R_2$) drops, which means that the impedance of transistor T is very low. Thus, the impedance fed back to the spark plug terminals is less than the apparent impedance of the spark plug Z, and the ignition spark is quenched, or it is not produced.

The resistor $R_1$ and the diode d supply the transistor T with a voltage if both the voltage at the spark plugs Z as well as on the secondary winding S and the supplementary winding S' is zero.

The advantages of the invention are, first, that the assembly time of the transformers is shorter than for the ignition systems of conventional constructions. Secondly, contrary to the heretofore known systems, the duration of the ignition spark can be extended arbitrarily and exactly fixed, the primary winding being energized by a chopper and, hence, by the ac voltage. This energization occurs independently of the engine speed. The magnetic fluxes are the same in all transformers, and no influence on the primary windings is exerted by the ignition process. Thirdly, power is supplied constantly to the ignition spark. The energy of the ignition spark can be varied arbitrarily, depending upon the regulation by the electronic control. All in all, an improved combustion of the air-fuel mixture is thus obtained, in particular at low engine speeds.

FIG. 10 shows a transformer, the core 1 of which is formed of four yokes 2 to 5 which are in a mutually cruciform arrangement, at the intersection of which is a bridge 6 whereon a primary winding P with terminals $A_1$ thereof is disposed. Located on the legs of the yokes 2 to 6, which extend parallel to the bridge 6, are the secondary windings $S_2$ to $S_5$ with terminals $A_2$ to $A_5$ thereof. Furthermore, auxiliary windings $S_{2'}$ to $S_{5'}$, which can be shorted and opened, respectively by non-illustrated mechanical, electromechanical or electronic switches, are disposed on the secondary windings $S_2$ to $S_5$. If these switches are closed i.e. if the auxiliary windings $S_{2'}$ to $S_{5'}$ are short-circuited, the terminals $A_2$ to $A_5$ of the secondary windings $S_2$ to $S_5$ carry no voltage.

The transformers are constructed, for example, with respect to the number of turn and air gap adjustment thereof, so that leakage inductances limit the current in the primary winding P when one or more of the auxiliary windings $S_{2'}$ to $S_{5'}$ are short-circuited.

The required voltage can be tapped from the terminals $A_2$ to $A_5$ of the secondary windings $S_2$ to $S_5$ when the auxiliary windings $S_{2'}$ to $S_{5'}$ are open.

The embodiment with four secondary coils shown in FIG. 10 is suited, for example, to activate the spark plugs of a motor vehicle Otto engine, the electrodes of the spark plugs being connected to the terminals $A_2$ to $A_5$ of the secondary windings $S_2$ to $S_5$. By appropriately controlling the non-illustrated mechanical, electromechanical or electronic switches which short-circuit and open, respectively, the auxiliary windings $S_{2'}$ to $S_{5'}$, the required voltage is applied to the spark plug electrodes at the required ignition time.

The embodiment shown in FIG. 10 relates to a 4-cylinder engine. In engines having a different number of cylinders, such as 5, 6, 8 or 12 cylinder engines, for example, a secondary coil is coordinated with each cylinder (in the respective examples, 5, 6, 8 or 12 secondary coils).

FIGS. 11 and 15 show two different embodiments of the ignition system wherein a transformer with a single secondary winding S is used. The secondary winding S is provided with an auxiliary winding S' having a circuit which can be shorted or opened by the mechanical switch I in FIG. 11 or by the electromechanical or electronic switch $\rho$ in FIG. 15. By short-circuiting the supplementary winding through the switches I and $\rho$, respectively, the voltage of the winding S on the secondary side disappears, as mentioned hereinbefore, or the intensity thereof is reduced so that no ignition spark is formed at the spark plugs. The secondary winding S is connected to the spark plugs $Z_1$ to $Z_n$ via interrupters $C_1$ to $C_n$.

The operation of the ignition systems according to FIGS. 11 and 15 explained in FIGS. 12 and 16, respectively, by way of the operating mode thereof in an internal combustion engine with two spark plugs $Z_1$ and $Z_2$. The upper level of the curves corresponds to closed switches and interrupters, respectively, and the lower level to open ones. As may be seen from FIGS. 12 and 15, the switch I and $\rho$, respectively, is closed at the start of the cycle and the interrupters $C_1$ and $C_2$ are open. Since the switch I and $\rho$, respectively, are closed, no voltage is applied to the secondary winding S either, as explained hereinbefore. The interrupter $C_1$ is then closed first, and the required voltage generated then by opening the switch I and $\rho$, respectively, so that ignition of the spark plug $Z_1$ takes place. The ignition spark at the plug $Z_1$ will continue to burn as long as the switch I and $\rho$, respectively, are open. After closing this switch, the ignition spark at the spark plug $Z_1$ goes out and the interrupter $C_1$ is opened subsequently. Thereafter, the interrupter $C_2$ is closed and the switch I and $\rho$, respectively, are opened so that the spark plug $Z_2$ receives the required ignition, which is maintained until the switch I and $\rho$, respectively, are closed again. Thereafter, thus after the voltage has disappeared again from the secondary side S, the interrupter $C_2$ is reopened so that the cycle can start anew.

Because the beginning and end of the ignition process are thus determined only by the switch I and $\rho$, respectively, and the interrupters $C_1$ to $C_n$ are always switched before and after, respectively, it is unnecessary to employ mechanical and electronic interrupters, respectively, which must meet high requirements. Consequently, the price of the ignition system according to the invention is considerably lower because, in addition to using only one single high voltage coil, interrupters are used which do not have to meet high voltage requirements.

For example, the interrupters $C_1$ to $C_n$ may be formed by reed relays.

An embodiment of an ignition system with an ignition distributor Zv is shown in FIG. 13. In it, a transformer with a primary winding P and a secondary winding S is used. The secondary winding S is connected to the distributor rotor L of the ignition distributor Zv. The distributor rotor L travels in direction of the curved arrow, for example, so that the high voltage of the secondary winding S reaches the spark plugs $Z_1$ to $Z_4$ successively via the contacts $K_1$ to $K_4$. In the embodiment shown in FIG. 13, an ignition sequence $Z_1$, $Z_2$, $Z_3$, $Z_4$ is depicted. Disposed on the secondary winding S is a supplementary winding S' which can be shorted and opened, respectively, by the switch I.

As may be seen from the schematic representation in FIG. 13, the distributor rotor L may, for example, take the form of a revolving circular segment. The longest ignition time or duration possible is then determined by the size of the circular segment, on the one hand, and by the rotary speed of the distributor rotor L, on the other hand. Due to the high voltage generated in the secondary windings S, mechanical contact between the distributor rotor L and the various contacts $K_1$ to $K_4$ disposed in the ignition distributor Zv is not absolutely necessary.

To assure as uniform an ignition voltage as possible, the start of the ignition process should not be timed so as to coincide with the instant the distributor rotor L reaches the contacts $K_1$ to $K_4$, nor should the end of the ignition process be timed so as to coincide with the instant the distributor rotor L leaves the respective contacts $K_1$ to $K_4$; rather, an appropriately shorter time should be specified.

The ignition time i.e. the opening and closing of the switch I, is controlled by non-illustrated sensors which are disposed at suitable locations of the engine. Preferably, contactless probes such as induction probes, field plate probes, photoelectric probes and the like are used for the purpose.

In FIG. 14, there is explained the operation of the ignition system according to the invention by way of the operating mode thereof in an internal combustion engine with four spark plugs $Z_1$ to $Z_4$, the ignition sequence corresponding to that of the embodiment shown in FIG. 13.

A represents the signals of the sensors and probes, respectively, through which the switch I in FIG. 13 receives the command to open and close, respectively, $t_a$ and $t_e$ are the beginning and the end, respectively, of the ignition period represented in B of FIG. 14 where the function of the switch I is depicted. The required high voltage is generated in the secondary winding S when the switch I is opened so that an ignition spark is produced at the spark plugs $Z_1$ to $Z_4$. The time when the segment of the distributor rotor L is in the area of the contacts $K_1$ to $K_4$ is shown in broken lines in the ignition diagrams according to FIG. 14. It may be seen from FIG. 14 that the ignition period is shorter than this time period. It is evident therefrom that a desired prolongation of the ignition period is made possible by enlarging the circular segment of the distributor rotor L.

In the embodiment example shown in FIG. 14, only the signal of one sensor and probe, respectively, for the control of the switch I is shown at A. However, several sensors may also be used for the control of the switch I, for example, furnishing the information required for the gas pedal position, the instantaneous vehicle speed, the underpressure in the suction pipe, the engine temperature and the like.

There is claimed:

1. Ignition system for an internal combustion engine in a motor vehicle having a transformer for generating ignition voltage, the transformer having a primary winding and a secondary winding, and a plurality of spark plugs connected to the secondary winding comprising chopper means connected to the primary winding and fed by a current source for activating the transformer, interrupter means series-connected to each of the spark plugs, the secondary winding being connected via said interrupter means to the spark plugs, a supplementary winding having a given effective flux range disposed at the secondary winding, said secondary winding being within said given effective flux range, said supplementary winding having a circuit wherein switch means are serially connected therewith, and sensor means disposed at given locations of the internal combustion engine and operatively connected with said switch means for actuating said switch means to open and short-circuit said circuit of said supplementary winding so as to control ignition time of the spark plugs in accordance with conditions sensed by said sensor means.

2. Ignition system according to claim 1 wherein said interrupter means comprise reed relays.

3. Ignition system according to claim 1 wherein said switch means are mechanical.

4. Ignition system according to claim 1 wherein said switch means are electromechanical.

5. Ignition system according to claim 1 wherein said switch means are electronic.

6. Ignition system according to claim 1 wherein said current source feeding said chopper means is a d-c source.

7. Ignition system according to claim 1 wherein said current source feeding said chopper means is a rectified a-c source.

* * * * *